United States Patent [19]

Hubbard

[11] Patent Number: 4,550,451

[45] Date of Patent: Nov. 5, 1985

[54] UNIVERSAL PLUMBING PIPE LOCATOR AND SUPPORT

[76] Inventor: George R. Hubbard, 1855 Rockhoff Rd., Escondido, Calif. 92026

[21] Appl. No.: 540,007

[22] Filed: Oct. 7, 1983

Related U.S. Application Data

[63] Continuation-in-part of Ser. No. 384,509, Jun. 3, 1982.

[51] Int. Cl.[4] ..... E03C 1/04

[52] U.S. Cl. ..... 4/192; 4/191; 4/419; 4/661; 248/56; 248/68.1; 285/64; 285/126; 285/158; 285/162; 174/135

[58] Field of Search ..... 4/191, 192, 419, 661, 4/252 R; 248/57, 68 R, 68 CB, 68 B, 68.1, 56, 205; 285/64, 126, 6, 158, 139, 162; 174/135

[56] References Cited

U.S. PATENT DOCUMENTS

| | | | |
|---|---|---|---|
| 885,924 | 4/1908 | Beaton . | |
| 1,056,759 | 3/1913 | Mallery . | |
| 2,128,040 | 8/1938 | Conners | 285/6.5 |
| 2,157,918 | 5/1939 | Rankin | 113/112 |
| 2,295,888 | 9/1942 | Bucknell et al. | 4/1 |
| 2,362,124 | 11/1944 | Ellinwood | 174/135 |
| 2,387,951 | 10/1945 | Slater et al. | 248/68 |
| 2,404,531 | 7/1946 | Robertson | 248/68 |
| 2,417,260 | 3/1947 | Morehouse | 174/135 |
| 2,463,407 | 3/1949 | Melton | 285/126 |
| 2,489,119 | 11/1949 | Burns, Jr. et al. | 248/68 |
| 2,611,658 | 9/1952 | McGuire | 306/27 |
| 2,628,799 | 2/1953 | Aaby | 248/57 |
| 2,661,483 | 12/1953 | Tortorice | 4/191 |
| 2,773,708 | 12/1956 | Beyerle | 285/64 |
| 2,813,568 | 11/1957 | Kilmarx, Jr. | 152/427 |
| 2,824,312 | 2/1958 | Tortorice | 4/191 |
| 2,843,363 | 7/1958 | Mailander | 257/124 |
| 2,897,533 | 8/1959 | Bull et al. | 16/2 |
| 2,956,468 | 10/1960 | Macy | 85/40 |
| 2,997,058 | 8/1961 | Hall | 137/360 |
| 3,021,103 | 2/1962 | Beyerle | 248/57 |
| 3,030,130 | 4/1962 | Appleton | 285/158 |
| 3,033,624 | 5/1962 | Biesecker | 308/238 |
| 3,078,551 | 2/1963 | Patriarca et al. | 29/157.4 |
| 3,097,843 | 7/1963 | Morrow | 269/40 |
| 3,243,206 | 3/1964 | Samer | 285/162 |
| 3,266,025 | 11/1965 | Roll | 4/192 |
| 3,272,542 | 9/1966 | Haulik et al. | 285/139 |
| 3,366,356 | 1/1968 | Fisher | 248/56 |
| 3,404,858 | 10/1968 | Levy | 248/68.1 |
| 3,424,856 | 1/1969 | Coldren | 248/56 X |
| 3,434,746 | 3/1969 | Watts | 285/162 |
| 3,438,686 | 4/1969 | Stone | 308/238 |
| 3,552,754 | 1/1971 | Bow | 277/178 |
| 3,559,730 | 2/1971 | Benjean | 165/178 |
| 3,562,847 | 2/1971 | Jemison | 16/2 |
| 3,572,770 | 3/1971 | Kagi | 285/158 |
| 3,690,609 | 9/1972 | Montesdioca | 248/68 B |
| 3,718,307 | 2/1973 | Albanese | 248/205 R |
| 3,788,582 | 1/1974 | Swanquist | 285/56 |
| 3,788,655 | 1/1974 | Hathaway | 277/212 F |
| 3,829,184 | 8/1974 | Chevret | 308/237 |
| 3,844,588 | 10/1974 | Jocsak | 285/162 |
| 3,944,175 | 3/1976 | Kearney | 248/68.1 X |
| 4,156,103 | 5/1979 | Dola et al. | 174/65 R |
| 4,192,477 | 3/1980 | Decky | 248/56 |
| 4,272,006 | 6/1981 | Kao | 228/183 |
| 4,299,363 | 11/1981 | Datschefski | 248/56 |

*Primary Examiner*—Henry K. Artis

*Attorney, Agent, or Firm*—Fulwider, Patton, Rieber, Lee & Utecht

[57] ABSTRACT

A locator and support for precisely locating and supporting plumbing pipes relative to structure of a building. The support includes a strap fastenable to the building structure and having a plurality of precisely located openings for receiving the pipes, the pipes being secured within the openings by an adhesive or by soldering, or by the clamping action of inserts carried by the strap and receiving the pipes. Such inserts are slotted to laterally receive the pipes, if desired, and are each characterized by a conical or tapered inner surface which spreads the skirts upon insertion of the pipes so that the radially enlarged skirts prevent separation of the inserts from both the strap and the pipes.

17 Claims, 11 Drawing Figures

UNIVERSAL PLUMBING PIPE LOCATOR AND SUPPORT

CROSS REFERENCE TO RELATED APPLICATION

This is a continuation-in-part of applicant's copending application Ser. No. 384,509filed June 3, 1982, entitled "Pipe Locator and Support".

BACKGROUND OF THE INVENTION

1. Field of the Invention

The present invention relates to plumbing fittings and particularly to a universal plumbing pipe locator for supporting pipes in a predetermined spaced apart relation.

2. Description of the Prior Art

Pipes adapted to mate with a plumbing fixture such as a sink or the like typically extend upwardly between building studs, and then project outwardly for connection to the fixture. The pipes must be securely fixed in place to prevent vertical, lateral and axial movements under the stress of use. The pipes must also be located a predetermined distance apart to precisely align them with the fixture inlets.

One prior art means for securing pipes between studs utilizes a strap to which are bolted elbows specially configured and oriented to receive the pipes, the vertical runs of the pipes being coupled to one end of the elbows, and the horizontal runs being coupled to the other end, as disclosed, in Beyerle, "Plumbing Assembly", U.S. Pat. No. 2,773,708. The system undesirably requires special elbows and fasteners for attaching the elbows to the strap.

Other prior art supporting straps include a single, continuous horizontal slot through which an elbow is mounted, the elbow being locked in place by a threaded fitting, as disclosed in Aaby, "Supporting Bracket for Water Pipe Fittings", U.S. Pat. No. 2,628,799.

In addition to the use of elbows bolted to a supporting strap, the prior art also teaches universal supporting bars to which straps are bolted, the straps in turn securing a pipe or an armored cable to the supporting bar. This is shown in Albanese, "Multi-Purpose Support Bar", U.S. Pat. No. 3,718,307.

Prior art universal straps further include integrally molded collars to which the pipes are fitted to hold the pipes in place, as seen in Tortorice, "Bracket for Valve Fixtures", U.S. Pat. No. 2,661,483.

These various devices of prior art each present the complications in that the plumber must manipulate specialized fasteners or the like to attach specially configured fittings to a support strap to hold the pipes in place. None of such devices is adapted to rigidly support the pipes and precisely align them with plumbing fixtures without using special bolted elbows, straps, fasteners, hooks or the like.

SUMMARY OF THE INVENTION

The present invention comprises a universal plumbing pipe locator and support having a supporting strap which includes a plurality of longitudinally spaced apart openings in the form of holes or slots, precisely spaced apart for receiving and thereby locating a pair of pipes in proper spaced relation for attachment to complemental conduits of a plumbing fixture or the like. A second plurality of smaller holes can be provided to accept nails or the like to secure the strap to usual building studs. Alternatively, a clamp can be used to attach the strap to a waste pipe or the like.

Location of the pipes in the strap openings prevents lateral and vertical movements of the pipes. Axial movement is prevented in the case of copper pipes by brazing or soldering the pipes to the strap. In such an application the strap is made of metal suitably coated with a cuprous layer. Where plastic pipes are involved, the strap may be made of either metal or plastic, and cylindrical plastic inserts are inserted into the openings in the strap. The plastic pipes are then pushed through the openings in the inserts and may be adhesively bonded to the adjacent surfaces of the inserts, although the use of adhesives is usually not necessary and, in some instances, suitable adhesives for certain types of plastic are not available.

In both embodiments the pipes are securely fixed against lateral, vertical and axial movement by attachment to the supporting strap, which in turn is fixed to the building studs by suitable fasteners.

The invention completely avoids any necessity for use of complex hardware. All that is required is to employ a length of the flat strap sufficient to bridge adjacent studs, nail the strap to the studs or fasten it to a waste pipe or the like, dispose the pipes through the proper spaced openings in the strap, and then attach the pipes to the strap, thereby automatically locating and fixing the pipes in position.

Other objects and features of the invention will become apparent from consideration of the following description taken in connection with the accompanying drawings.

DESCRIPTION OF THE PREFERRED EMBODIMENTS

Figure 1:
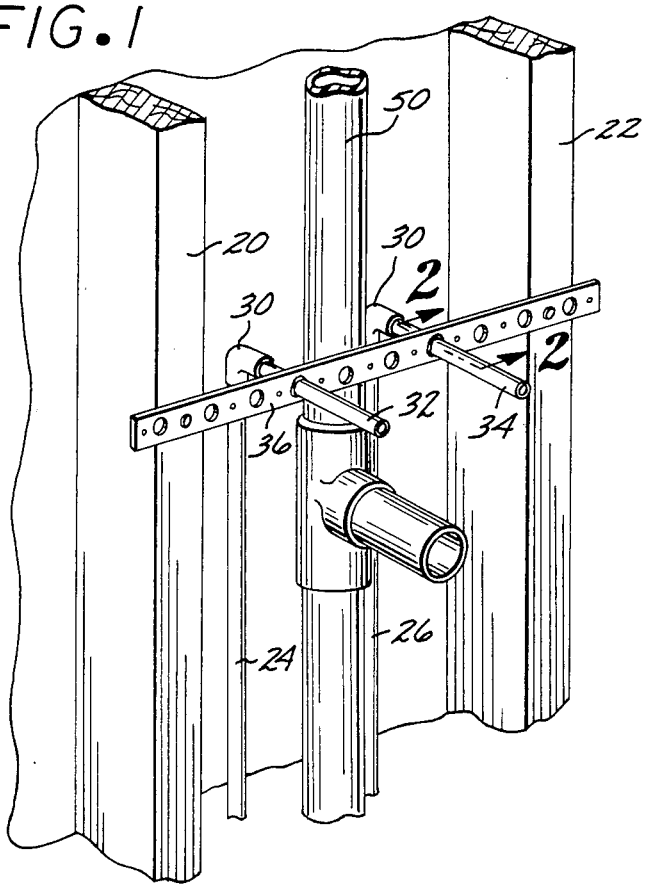
FIG. 1 is a perspective view of the present universal plumbing pipe locator and support as it would be used in locating copper pipes for alignment with a plumbing fixture (not shown)

Referring now to the drawings, and particularly to FIG. 1, there is illustrated a typical building structure characterized by a plurality of vertically oriented wooden studs which are spaced apart at standard intervals, a pair of such studs being illustrated at 20 and 22. Typically, vertical runs 24 and 26 of hot and cold water pipes are located between the studs 20 and 22, and are coupled to elbows 30, respectively. The elbows 30 mount horizontal runs or pipes 32 and 34 which project horizontally and inwardly or toward the interior of the building.

The pipes 32 and 34 must be properly located in position for attachment to a pair of pipes (not shown) of a fixture such as a sink in a bathroom or kitchen. Further, the pipes must be fixed against lateral, vertical and axial movements during use of the sink.

According to one embodiment of the present invention, an elongated supporting strip or strap 36 is provided with a plurality of fastener or nail openings 46 which are longitudinally spaced apart at predetermined distances for nailing the strap 36 to wooden studs 20 and 22. Sheet metal screws or other fasteners are used in the case of metal studs. Preferably the distance between adjacent nail openings 46 is equal to or less than the width of a stud 20 or 22 to insure that nail openings overlie the studs regardless of the location of the pipes 32 and 34. In this regard, the strap 36 also includes a plurality of pipe openings 48 spaced apart at predetermined distances to receive the pipes 32 and 34.

The strap 36 is relatively inexpensive since it can be stamped in predetermined lengths out of flat sheet stock. Plumbing codes permit various standard spacings between the conduits of plumbing fixtures such as sinks. The spacing or distance between the pipes 32 and 34 need not be this distance, but should for appearance be spaced some predetermined distance apart, such as equal distances on opposite sides of the usual waste pipe 50. Accordingly, the pipe openings 48 are spaced apart at distances such that a pair of them are adapted to accept pipes 32 and 34 at distances which will facilitate attachment to the fixture conduits.

Figure 4:
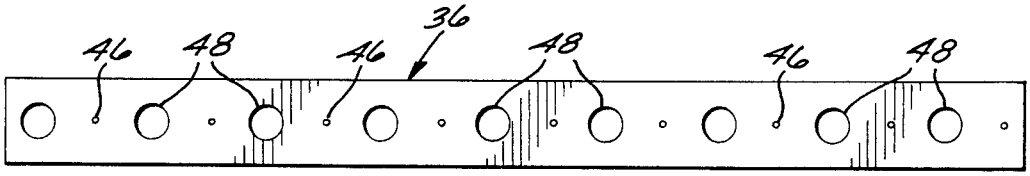
FIG. 4 is a front elevational view of the supporting strap of FIG. 1.
Figure 5:
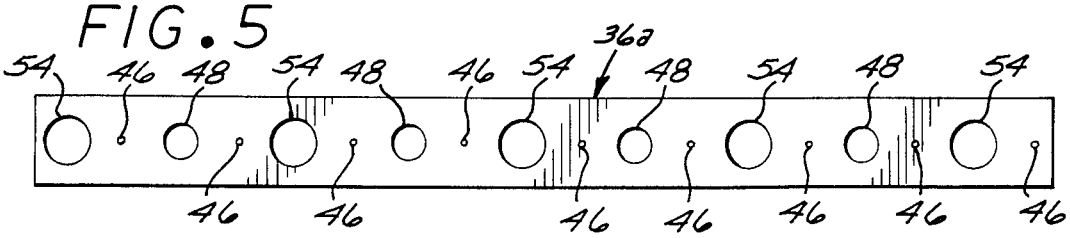
FIG. 5 is a front elevational view of a second embodiment of the supporting strap.

The pipes 32 and 34 are typically one-half inch copper tubing and the openings 48 illustrated in FIG. 4 are therefore sized to accept such tubing. If desired, a strap **36*a* can be utilized, as seen in FIG. 5, in which the openings 48 alternate with holes 54 larger than the holes 48 to accept, for example, three-quarter inch copper tubing. Thus, the strap 36*a* of FIG. 5** can be marketed for use with either one-half or three-quarter inch pipe. Of course, the strap could also include another series of larger diameter openings, such as 1", if desired.

Figure 2:
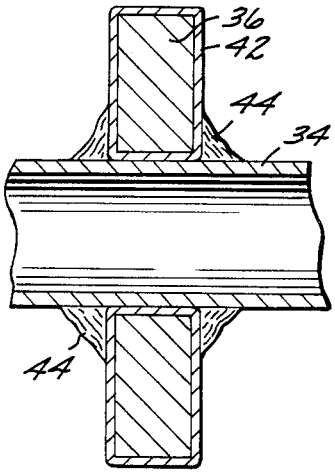
FIG. 2 is a view taken along the line 2—2 of FIG. 1.
Figure 3:
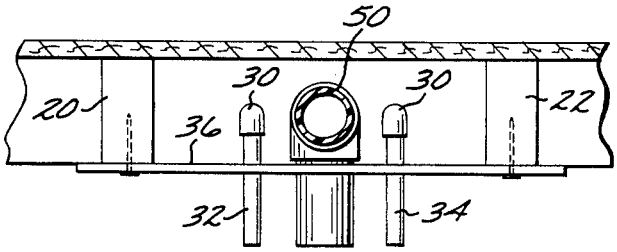
FIG. 3 is a top plan view of the pipe locator and support and the associated structure illustrated in FIG. 1.

In the embodiment illustrated in FIG. 1, the supporting strap 36 is made of metal and coated with a cuprous layer 42 so that it may be brazed or soldered to the copper pipes 32 and 34, the soldering material 44 being illustrated in FIG. 2. This arrangement eliminates any need for attachment of special elbows or fixtures to the strap 36 to accept the pipes 32 and 34. The solder attachment is secure enough to prevent axial movement of the pipes 32 and 34, and they are secured in neat, horizontal alignment.

As will be obvious, the strap 36 could itself be made of a copper alloy to enable use of the soldering material 44.

The straps 34 can easily be stamped out of flat sheet stock in any suitable length.

Figure 6:
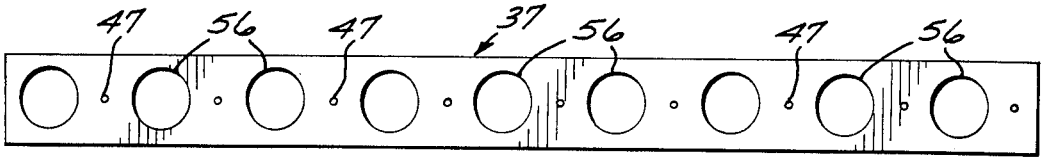
FIG. 6 is a front elevational view of a third embodiment of the supporting strap.

FIG. 6 illustrates a form of strap 37 which does not include any openings for nails or screw fasteners for attachment of the strap to building studs. Instead, a pair of slots 47 are provided to accept a clamping band (not shown) adapted to encircle the waste pipe 50 to secure the strap 37 in position. Such a circular clamp is merely an alternative means of securing the strap in position, the function of the strap 37 in supporting and locating the pipes in position being the same as before.

Figure 9:
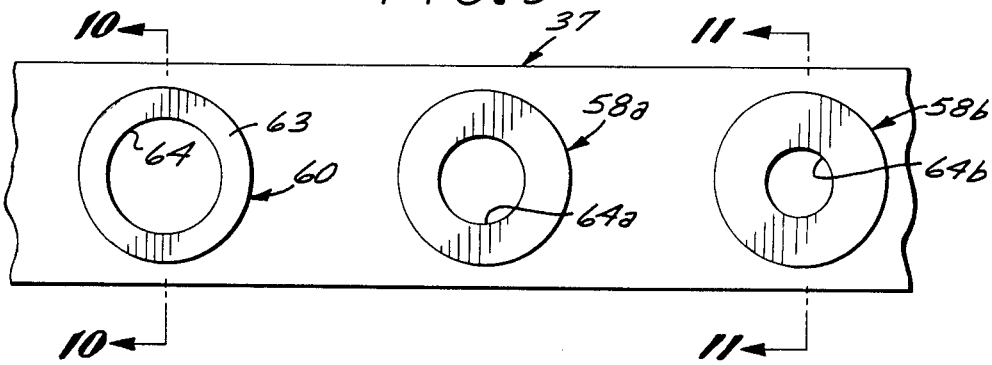
FIG. 9 is a partial front elevational view illustrating cylindrical inserts of different internal diameters for accepting pipes of different external diameters, the inserts being shown in a fourth embodiment of the supporting strap.

Instead of the circular openings 48 of FIG. 4, or 54 of FIGS. 5 and 6, the strap could be provided with lateral openings 56, as illustrated in the strap **37*a* of FIG. 9. The purpose of the openings 56 is to permit lateral mounting of the strap 37*a*** to a pipe, as will be seen.

In the event that plastic pipes rather than copper pipes are to be supported in position, the strap 37 used would preferably be made of metal, although it could be made of a plastic material, such as polyvinyl chloride or the like. The strap would include nail openings 46 if it was to be nailed to building studs, or it could include slots 47 if it is to be clamped to a waste pipe or similar building structure. In other words, the same strap arrangement can be used for plastic pipe as is used for copper pipes except that plastic inserts 60 are used to receive the plastic pipes.

Assuming the strap 37 of FIG. 6 is utilized, a pair of cylindrical inserts 60 are fitted into the pair of openings 54 providing the desired spacing. The material of each insert 60 is preferably a plastic such as polyethylene. If desired, a plastic such as polyvinyl chloride could be used if it is to be bonded to the pipes.

Each insert 60 includes a skirt having an outer cylindrical body or sleeve 62 and an inner cylindrical body or sleeve 62. The sleeve 62 is of a diameter slightly larger than the strap opening 54, while the inner diameter of the sleeve 64 at its outer end is approximately the same as the pipe 24. The inner surface of the sleeve 64 is generally conical, diminishing in diameter in an inner direction for a purpose which will be explained.

Figure 7:
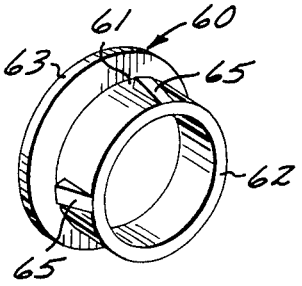
FIGS. 7 and 8 are, respectively, rear and front perspective views of a cylindrical insert adapted to fit within the straps of FIGS. 5, 6 or 9.
Figure 8:
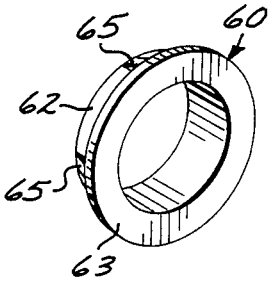

As seen in FIGS. 7 and 8, insert 60 includes a circular flange 63 adjacent the sleeve 62. The flange 63 abuts against the surface of the strap 37 when the insert 60 is fitted within the opening 54.

A space is provided between outer and inner sleeves 62 and 64 for lightness and to minimize the amount of plastic material required. The sleeves are interconnected by four radially directed connecting webs 65, as best seen in FIGS. 7 and 8.

Each insert 60 includes a radial slot 66 extending through the skirt defined by the sleeves 62 and 64. The plastic material of the insert 60 is sufficiently resilient to enable the skirt of each insert 60 to be inwardly squeezed to partially close the slot 66 and to enable the insert 60 to pass into a strap opening 54 in position to receive a pipe 34.

When the insert 60 is in position, the skirt opens slightly at the slot 66, tending to maintain the insert 60 in position.

Figure 10:
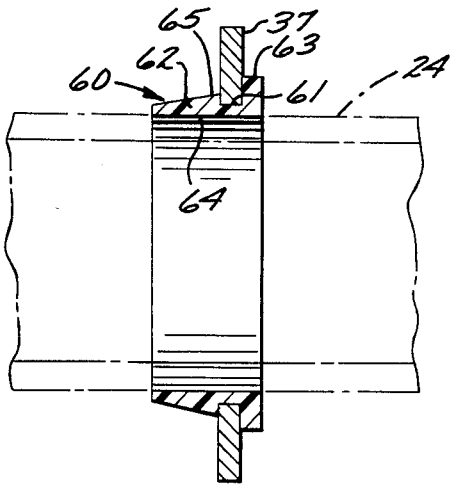
FIG. 10 is a cross sectional view of the insert of FIG. 7 prior to insertion of a pipe.
Figure 11:
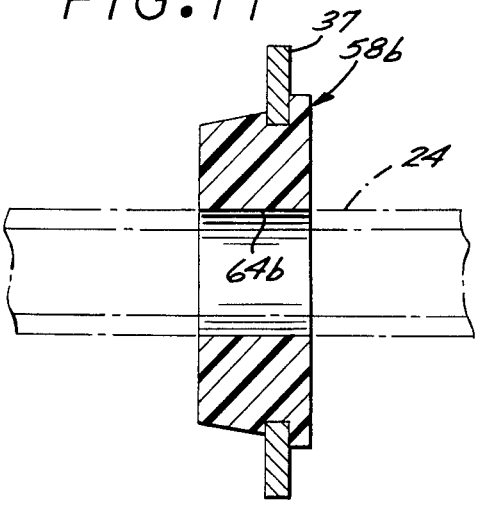
FIG. 11 is a view similar to FIG. 10, but illustrating the insert after insertion of a pipe.

When the pipe 34 is inserted into the inner sleeve 64, the pipe encounters an increasingly smaller opening and outwardly spreads the insert skirt from the configuration of FIG. 10 to that of FIG. 11, the inner sleeve 64 thereby assuming a generally constant diameter. The outward movement of the outer sleeve 62 is accompanied by a widening of the slot 66 so that the flared outer surface of the sleeve 62 is characterized by a diameter greater than the strap opening 54. In addition, the widened slot 66 causes the insert skirt to tightly engage the margins of the opening 54, and tightly grip the pipe 34 so tht it cannot move axially.

The insert 60 can also be used with copper pipes, if desired. The clamping action of the insert 60 upon the pipe can be made sufficiently great that rigid brazing or soldering of the pipe to a metal strap 36 would not be necessary.

In FIG. 9 the insert 60 is shown at the left. If smaller pipes than the pipe 37 are involved, the insert could be made with a smaller diameter inner sleeve 64, as illustrated at 60*a*, or a still smaller diameter inner sleeve 64, as illustrated at 60*b*.

FIG. 9 also illustrates how the strap 37*a* could be provided with lateral openings 56 adapted to laterally slidably accept the inserts, if desired. Such an arrangement is advantageous where it is inconvenient to insert the end of a pipe through the insert 60. Instead, the insert 60 can be spread apart at the slot 66 to laterally fit onto the pipe. The insert 60 and the associated pipe are then laterally slid into position within the opening 56, thereby causing the slot 66 to tend to close and tightly grip the pipe.

From the foregoing it will be seen that the present universal plumbing pipe locator and support is readily adapted for use with either metal or plastic pipe. Precise location and support of metal pipe is simply a matter of disposing the pipes through the correctly spaced apart pipe openings in the supporting strap and thereafter nailing or otherwise fastening the strap to adjacent building studs or to a waste pipe or the like.

In the case of plastic pipe, a strap made of either metal or plastic is utilized to snugly receive plastic inserts. Precise location and alignment of the pipes with the plumbing fixture is then easily established by disposing the plastic pipes through the cylindrical inserts. As indicated, such inserts can also be used with metal pipe if brazing or soldering procedures are inconvenient.

Various modifications and changes may be made with regard to the foregoing detailed description without departing from the spirit of the invention.

I claim:

1. In combination with a pair of spaced apart building studs and an associated pair of pipes, an improved universal plumbing pipe locator and support for precisely and rigidly fixing said pipes permanently in position relative to said studs, said improved locator and support comprising:

an elongated supporting strap having upper and lower edges, and further having a first plurality of longitudinally aligned openings located between said upper and lower edges and extending the full length of said strap, said openings being spaced apart by a predetermined distance wherein said pipes are alignable and in registration therewith, said elongated supporting strap adapted to be dimensioned to a predetermined elongated length, said pipes projecting through a pair of said openings, said strap further having a second plurality of openings extending the full length of said strap;

fastener means extending through said plurality of openings and permanently fastenening said strap to said studs; and means fixing said pipes within said pair of openings, whereby said pipes are fixed in position in predetermined spaced apart relation for attachment to a pair of plumbing fixture conduits.

2. The combination of claim 1 wherein said first plurality of openings in said strap are cylindrical and circumferentially coextensive with the adjacent circumference of said pipe.

3. The combination of claim 1 wherein said first plurality of openings in said strap are laterally open whereby said pipes may be laterally received therein.

4. The combination of claim 1 wherein said means fixing said pipes comprises cylindrical inserts disposed through said pair of openings and centrally receiving said pipes.

5. The combination of claim 1 wherein said first plurality of openings are of two different diameters and alternate along the length of said strap.

6. The combination of claim 4 wherein each of said inserts is characterized by a flange engaged upon one face of said strap, and a skirt projecting from the opposite face of said strap, said skirt in a relaxed state having an inner surface of diminishing diameter in a direction away from said opposite face whereby location of one of said pipes within said surface is accompanied by outward deformation of said skirt to a diameter greater than that of the associated one of said openings.

7. The combination of claim 4, wherein each of said inserts includes a radially extending slot whereby the associated one of said pipes may be laterally received therein.

8. The combination of claim 6 wherein each of said inserts includes a radially extending slot whereby the associated one of said pipes may be laterally received therein.

9. The combination of claim 6 wherein said skirt comprises spaced apart coaxial inner and outer sleeves, and radially directed webs connecting said sleeves.

10. A universal plumbing pipe locator and support for precisely and rigidly fixing permanently in position a pair of pipes located adjacent a pair of building studs, said locator and support comprising:

an elongated supporting strap having upper and lower edges, and further having a first plurality of longitudinally aligned openings extending the full length of said strap and located between said upper and lower edges for receiving said pipes, said first plurality of openings being spaced apart by a predetermined distance wherein said pipes are alignable and in registration therewith, said elongated supporting strap adapted to be dimensioned to a predetermined elongated length, said strap further having a second plurality of openings extending the full length of said strap; and fastener means adapted to extend through said second plurality of openings for permanently fastening said strap to said building studs.

11. A universal plumbing pipe locator and support according to claim 10 wherein said first plurality of openings in said strap are laterally open whereby said pipes may be laterally received therein.

12. A universal plumbing pipe locator and support according to claim 10 and including means adapted to fix said pipes within a pair of said first plurality of openings, said means comprising cylindrical inserts adapted to fit within said pair of openings and centrally receive said pipes.

13. A universal plumbing pipe locator and support according to claim 12 wherein each of said inserts is characterized by a flange for engagement upon one face of said strap, and a skirt for projection from the opposite face of said strap, said skirt in a relaxed state having an inner surface of diminishing diameter in a direction away from said opposite face whereby location of one of said pipes within said surface is accompanied by outward deformation of said skirt to a diameter greater than that of the associated one of said pair of openings.

14. A universal plumbing pipe locator and support according to claim 13 wherein each of said inserts includes a radially extending slot whereby the associated one of said pipes may be laterally received therein.

15. A universal plumbing pipe locator and support according to claim 13 wherein said skirt comprises spaced apart coaxial inner and outer sleeves, and radially directed webs connecting said sleeves.

16. A universal plumbing pipe locator and support for precisely and rigidly fixing in position at least one pipe adjacent fixed building structure, said pipe locator and support comprising:

a supporting strap having opposite flat faces and means for securement of said strap to said building structure, said strap further having at least a pair of openings spaced apart by a predetermined distance, said supporting strap adapted to be dimensioned to a predetermined elongated length; and a circumferentially discontinuous insert having an annular flange and a cylindrical skirt, said skirt being freely movable into at least one of said openings to seat said flange against an adjacent face of said supporting strap, said insert further having a central bore terminating in a flange end and a skirt end and axially tapering from a maximum diameter adjacent said flange end to a minimum diameter adjacent said skirt end whereby forcible insertion into said bore of a pipe having an exterior diameter approximating the diameter of said flange end spreads and flares said skirt for tightly gripping said pipe adjacent said skirt end and thereby constraining said pipe against axial movement, and for tightly engaging the margins of said opening and thereby constraining said insert against axial movement.

17. A universal plumbing pipe locator and support according to claim 16 wherein said skirt comprises spaced apart coaxial inner and outer sleeves, and radially directed webs connecting said sleeves.

* * * * *

UNITED STATES PATENT AND TRADEMARK OFFICE

CERTIFICATE OF CORRECTION

PATENT NO. : 4,550,451

DATED : November 5, 1985

INVENTOR(S) : George R. Hubbard

It is certified that error appears in the above-identified patent and that said Letters Patent is hereby corrected as shown below:

Sheet 2 of the drawings is replaced with the following:

FIG. 6

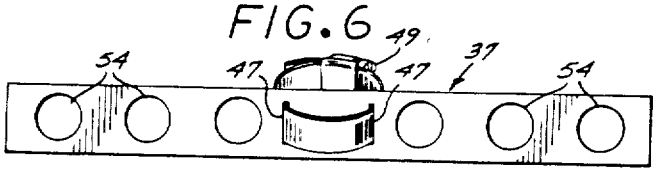

FIG. 7

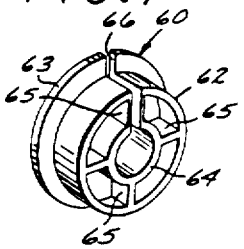

FIG. 8

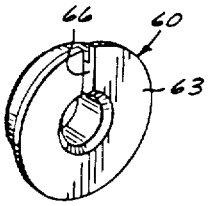

UNITED STATES PATENT AND TRADEMARK OFFICE

CERTIFICATE OF CORRECTION

PATENT NO. : 4,550,451

DATED : November 5, 1985

INVENTOR(S) : George R. Hubbard

It is certified that error appears in the above-identified patent and that said Letters Patent is hereby corrected as shown below:

FIG. 9

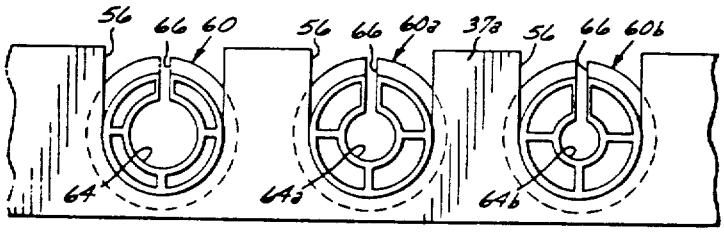

UNITED STATES PATENT AND TRADEMARK OFFICE

CERTIFICATE OF CORRECTION

PATENT NO. : 4,550,451 Page 3 of 3

DATED : November 5, 1985

INVENTOR(S) : George R. Hubbard

It is certified that error appears in the above-identified patent and that said Letters Patent is hereby corrected as shown below:

FIG. 10

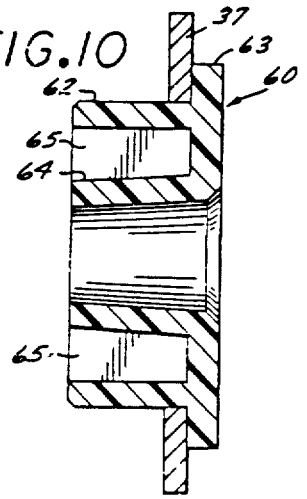

FIG. 11

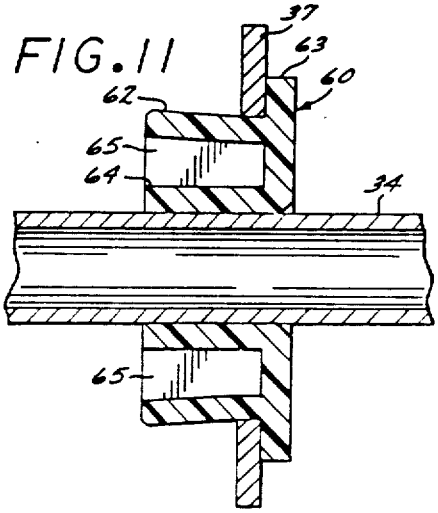

Signed and Sealed this

Tenth Day of August, 1993

*Attest:*

*Attesting Officer*

Michael K. Kirk

MICHAEL K. KIRK

*Acting Commissioner of Patents and Trademarks*